US010154708B2

(12) United States Patent
Ract

(10) Patent No.: US 10,154,708 B2
(45) Date of Patent: Dec. 18, 2018

(54) DECORATIVE FASHION JEWELLERY COMPRISING A LINING PRESSED INTO CONTACT WITH A CUTOUT PIECE OF METAL PLATE

(71) Applicant: GL ALTESSE, Saint-Martin-de-Valamas (FR)

(72) Inventor: Nicolas Ract, Le Cheylard (FR)

(73) Assignee: GL ALTESSE, Saint-Martin-de-Valamas (FR)

( * ) Notice: Subject to any disclaimer, the term of this patent is extended or adjusted under 35 U.S.C. 154(b) by 0 days.

(21) Appl. No.: 15/787,717

(22) Filed: Oct. 19, 2017

(65) Prior Publication Data

US 2018/0035766 A1 Feb. 8, 2018

Related U.S. Application Data

(63) Continuation of application No. 15/276,295, filed on Sep. 26, 2016.

(30) Foreign Application Priority Data

Sep. 24, 2015 (FR) ..... 15 58997

(51) Int. Cl.

| | |
|---|---|
| ***A44C 5/12*** | (2006.01) |
| ***A44C 13/00*** | (2006.01) |
| ***A44C 5/00*** | (2006.01) |
| ***A44C 7/00*** | (2006.01) |
| ***A44C 9/00*** | (2006.01) |
| ***A44C 15/00*** | (2006.01) |
| *A44C 17/02* | (2006.01) |

(52) U.S. Cl.

CPC ..... *A44C 5/0007* (2013.01); *A44C 5/0092* (2013.01); *A44C 5/12* (2013.01); *A44C 7/002* (2013.01); *A44C 9/0053* (2013.01); *A44C 15/0025* (2013.01); *A44C 13/00* (2013.01); *A44C 17/0208* (2013.01)

(58) Field of Classification Search

CPC ... A44C 5/0084; A44C 5/0092; A44C 9/0053; A44C 9/0061; A44C 9/0084; A44C 5/0007; A44C 7/002; A44C 5/003; A44C 15/0025; A44C 15/0208; A44C 17/0208; A44C 13/00; A44C 5/00; A44C 9/00; A44C 7/00; A44C 5/0015; A41F 9/002; A41D 20/00; A41D 27/08; A41D 27/02; A41D 27/00; A41B 7/00; A45C 3/08; A45C 13/08; A45C 3/00; G04G 17/00

USPC ..... 428/542.2, 542.6; 40/611.13, 790; D11/3, 4, 5, 38; 63/7

See application file for complete search history.

(56) References Cited

U.S. PATENT DOCUMENTS 183,374 A * 11/1875 Cullinan ..... A44C 5/0092
2,116,810 A * 5/1938 Warner ..... A45C 11/16 206/6.1

* cited by examiner

*Primary Examiner* — Jack W Lavinder
(74) *Attorney, Agent, or Firm* — Joseph G. Chu; JCIP

(57) ABSTRACT

Portable decorative element with a metal structure (2) made from cutout metal plate with decorative openings, on the back face of which there is a lining forming a plate that can be seen through these openings, that can be elastically bent (4), the back face of the metal plate comprising attachment means (10, 12) holding the lining (4) in place and clamping this lining, pressing it into contact with the back face of the structure.

48 Claims, 3 Drawing Sheets

DECORATIVE FASHION JEWELLERY COMPRISING A LINING PRESSED INTO CONTACT WITH A CUTOUT PIECE OF METAL PLATE

RELATED APPLICATION

This is a continuation application of U.S. application Ser. No. 15/276,295 entitled DECORATIVE FASHION JEWELRY COMPRISING A LINING PRESSED INTO CONTACT WITH A CUTOUT PIECE OF METAL PLATE filed on Sep. 26, 2016, which claims priority to the French Patent Application No. 1558997 filed on Sep. 24, 2015, the contents of which are incorporated by reference in their entirety herein.

BACKGROUND OF THE INVENTION

This invention relates to a decorative fashion jewelry item combining several elements that may have different appearances and/or may be made from different materials.

Modern metal plate cutting methods can be used to make various fine cutouts from metals such as steel, brass, copper, aluminium, silver or gold, in particular different shaped openings, to make jewelry or fashion accessories.

It is known that a slightly supple lining can be permanently fixed on the inside face of the cut metal plate appearing through openings in this metal plate, with a different appearance and with different colours so as to create an aesthetic decorative effect.

Noble materials such as high quality natural or synthetic fabrics or leather are preferably used for the inside lining. The rigid metal plate then controls the general shape of the decorative element and a wear-resistant external appearance that may be gloss, satin or mat, and the inside lining forms a more supple and warmer material for which the nature, appearance and colour provide a contrast with the metal.

Bracelets, brooches, ear jewelry and open collar necklaces, comprising a cut metal sheet forming a rigid structure can thus be made with specific curves depending on their function. For example, bracelets can be made formed from a wound metal strip with an opening such that the wrist can be passed through in an appropriate manner.

Additional elements can be fitted on the lining, particularly to facilitate attachment or wearing, such as a cord or a chain around the neck for a pendant, or a pin to fasten a brooch onto clothing.

For jewelry such as bracelets that is directly in contact with the skin, the more supple inner lining gives a more pleasant feel on the skin.

However, one problem that arises with this type of decorative element is that when the internal lining is fixed permanently to the metal plate by different means to assure good support and to press it into contact under the metal plate, this lining cannot be quickly and easily replaced.

Furthermore, detachment of the lining usually requires the use of special tools, particularly to remove clamping screws or rivets, and can damage some of the elements. The disassembly and reassembly operation can be slow and tedious if an impeccable appearance and finish are to be kept, to justify the decorative function.

It is then impossible to make variants of the same jewel or decorative element quickly by replacing the lining or the decorative metal plate, although the trend is increasingly towards customising fashion accessories, for example to adapt them to the clothes being worn, type of activities planned, or a need for frequent renewal to avoid repeatedly wearing the same decoration.

BRIEF SUMMARY OF THE INVENTION

In particular, the purpose of this invention is to avoid these disadvantages of prior art and to enable a reversible attachment of a decorative lining under a rigid structure of a decorative element such as a jewel.

A reversible attachment is an attachment that can be made and removed manually without any tools. On the contrary, a permanent attachment is an attachment for which a tool is necessary to make or to remove it (crimping, screwing, gluing, etc.). Thus, an attachment means to make a manual reversible attachment is qualified as a "reversible attachment means" for the purposes of this text.

To achieve this, this invention discloses a portable decorative element with a rigid structure with decorative openings on the back face of which during use there is a lining forming a plate that can be seen through these openings, that can be elastically bent, this element being remarkable in that the back face comprises reversible attachment means capable of holding the lining in place and clamping this lining, pressing it into contact with the back face of the structure.

One advantage of this decorative element is that the attachment means squeezing the lining in the lateral directions of the plate apply a stress on this lining to hold it in place in the structure without play and therefore without wear, and create a pressure that tends to push the plate outwards when it is bent which forces it into contact on the back face to give the required aesthetic effect.

An attachment means that does not meet these conditions is for example a U-shape guide in which the lining must be slid to be positioned. Indeed, the sliding causes abrasion of the lining and does not provide its clamping against the back face of the structure since the guide must be greater than the lining height to allow its sliding. If the height is not higher, fixing is not reversible because multiple insertions/outputs are impossible.

The adjective "lateral" means that stress is applied through the edges of the lining.

The lining can be easily and quickly disengaged to remove it and replace with another lining, without the use of tools and without damage to any component. This lining can also be used with another metallic structure.

The portable decorative element according to the invention may also comprise one or several of the following characteristics, that may be combined with each other.

The rigid structure can be made from a cutout metal plate with decorative openings.

According to one embodiment, the back face comprises lateral tabs forming attachment means on which the edges of the lining bear. In this case, the lateral tabs are advantageously formed by bending the edge of the structure metal plate. These lateral tabs are easy to make.

For the purposes of this text, "lateral tabs" means that the tabs are located on the edges of the rigid structure. These tabs may be isolated or they may form a continuous edge, in which case they form a support cage. The lateral tabs may be arranged on the sides or at the ends of the rigid structure.

According to another alternative or complementary embodiment, the decorative element comprises studs that force the lining onto the back face of the structure. The studs hold the lining in place in the different directions.

In this case, the stud advantageously comprises an approximately spherical head fixed on the back face of the structure at a distance such that there is compression through the thickness of the lining underneath this head.

This compression forces the lining into contact with the back face of the structure.

Advantageously, the lateral distance between two attachment means following the contour of the back face of the structure, is less than the same corresponding distance on the lining, such that these attachment means apply lateral pressure.

In particular, the decorative element may form a bracelet comprising a strip of bent plates arranged approximately in a circle, with an opening through which the wrist can pass.

This bracelet advantageously comprises two studs located on the back face of the structure, close to each end of the metal plate strip, and lateral tabs on the sides of this strip forming supports on the edges of the lining. This result is that the lining is held in place firmly in all directions, while it can be quickly removed.

Alternatively, the bracelet may comprise two lateral tabs called "end" tabs located on the back face of the structure, close to or at each end of the rigid structure, and lateral tabs on the sides of this structure forming supports on the edges of the lining.

The lateral end tabs may advantageously include a claw structure so that the lining is kept in compression throughout its thickness under the lining under this claw.

In particular, the structure can form a disk comprising folded edges forming attachment means.

In particular, the lining can include two leather faces. The leather faces form a material with good durability and also a pleasant contact with the skin.

Advantageously, the lining has two faces with different colours, designed to be turned alternatively to face the structure. Thus a decorative element with two different appearances can thus be obtained quickly with the purchase of a single lining.

Another purpose of the invention is a decorative lining designed to cooperate with reversible attachment means of a decorative element according to the invention, remarkable in that it comprises means of cooperation with reversible attachment means.

Another purpose of the invention is a decoration kit for a decorative element according to the invention, comprising a plurality of the previous decorative linings, each provided with means of cooperation with reversible attachment means.

BRIEF DESCRIPTION OF THE DRAWINGS

The invention will be better understood and other characteristics and advantages will become clearer after reading the following description given as an example, with reference to the appended drawings in which:

FIGS. 10A and 1013 show a front view and a side view respectively of ear jewelry according to the invention.

DETAILED DESCRIPTION OF THE PREFERRED EMBODIMENTS

Figure 1:
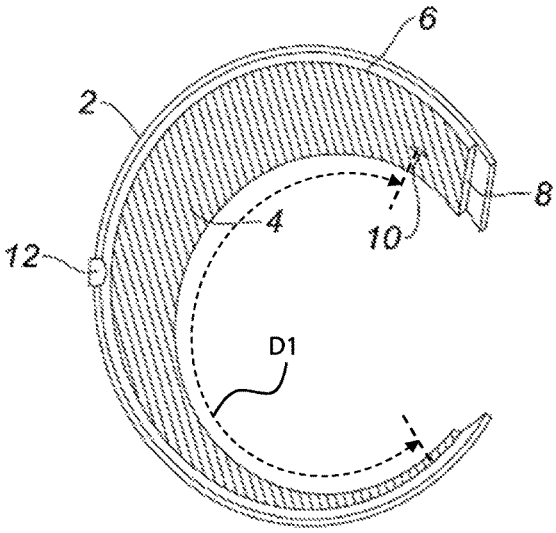
FIG. 1 shows a bracelet forming a decorative element according to the invention.

FIG. 1 presents a bracelet comprising a rigid structure 2 formed in a cut strip of metal plate that is curved to form a loop with an opening through which the wrist can pass.

Other materials can be used to make the rigid structure, for example wood or a rigid polymer.

The openings 14 may be made by cutting, grinding or by a means other than continuous edge to edge attachment of parts so as to leave open spaces between the parts. For example, parts can be welded to each other so as to obtain the rigid structure with openings according to the invention.

A leather lining 4 in contact with the inside of the metal structure 2 on its back face, forms a rectangle for which the longs sides 6 are adjusted on the edges of the metal plate, and the short sides 8 are slightly set back from this metal plate.

The lining 4 forms a plate that can be elastically curved, fixed to the inside of the structure by two studs 10 each located on the centre line of the strip close to one end of this strip, and two lateral tabs 12 each arranged in the middle of a long side of this structure.

Figure 11:
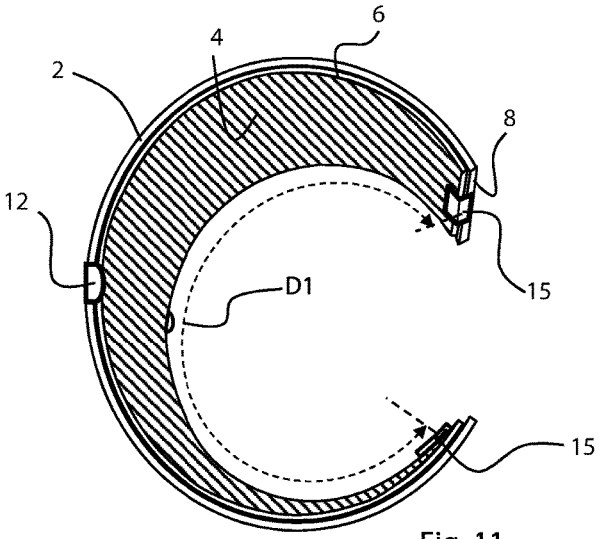
FIGS. 11 and 12 show an alternative according to the invention of the bracelet in FIG. 1 and of the leather lining of this bracelet, respectively.

Alternatively, as illustrated on FIG. 11, the bracelet may comprise two lateral tabs called "end" tabs located on the back face of the structure, close to or at each end 8 of the metal plate strip, and lateral tabs on the sides 6 of this strip forming supports on the edges of the lining. The lateral end tabs 15 may advantageously include a claw structure so that the lining is kept in compression throughout its thickness under the lining.

Figure 12:
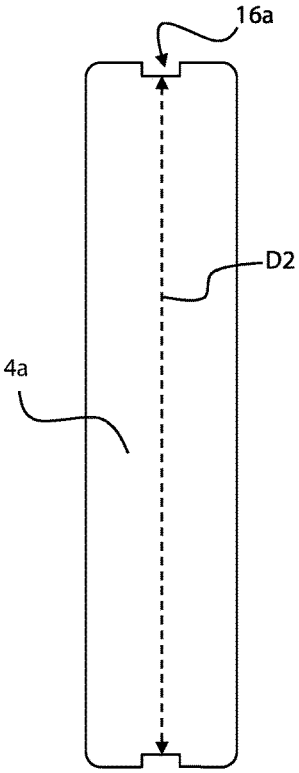

An example lining compatible with this embodiment is illustrated in FIG. 12. The decorative lining 4*a* comprises means 16*a* of cooperation with the reversible attachment means 15 of the structure. On this example, the cooperation means consist of notches 16*a*. The lateral tabs 15 can engage in these notches 16*a* so as to transversely block the lining relative to the rigid structure, and apply a pressure that tends to bend it and push it towards the metallic structure, which forces it into contact with the back face to provide the required aesthetic effect. To achieve this, the distance D2 between the ends of the notches 16*a* is slightly more than the corresponding distance between the lateral tabs 15 along the back face of the rigid structure 2.

More generally, the attachment means (the studs 10 and the lateral tabs 12, or the lateral end tabs 15 and the lateral tabs 12) squeeze the lining along the lateral directions of the plate: longitudinal along the centre-line passing through the studs; and transverse along the centre line connecting the lateral tabs located on the edges of the rigid structure. They apply a stress on the lining keeping it in contact in the structure without play and therefore without wear, and generate a pressure that tends to bend it and push it towards the metal structure, which forces it into contact on the back face giving the required aesthetic effect.

The thickness of the metal plate of the structure 2 is about 1 to 2 mm, the thickness of the leather lining 4 may be up to about 4 mm. A slightly supply leather is chosen with an elasticity and shape memory such that it can return to its form after bending. If necessary, a stack of leather pieces can be assembled together making the lining semi-rigid, for example with a flexible central core about 1/10 mm thick.

Figure 2:
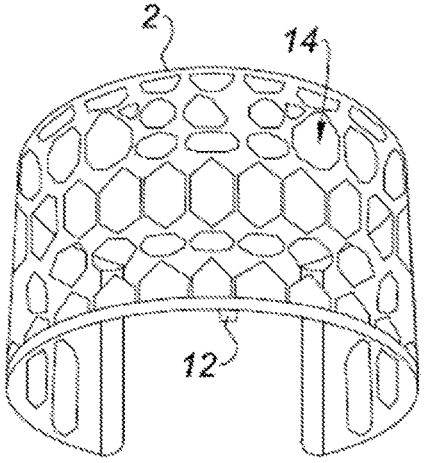
FIGS. 2 and 3 present the metal plate and the leather lining of this bracelet, detached from each other.

FIG. 2 shows the metal plate of structure 2 cut out from a metal strip such as a steel or a brass, comprising aligned openings 14 over its entire surface area, with geometric contours that can occupy more than half of the total surface area. The result obtained is a simple clean pattern, highlighting the motifs forming a sort of metal lace. Other cut types can be used, for example to form writing.

Cuts in the structure 2 can also be combined with stamping or engraving on the metal plate surface, to form other decorative effects such as writing. The surface of the structure 2 may be polished, satin or mat, comprising a metal or a coating with good mechanical strength and resistance to oxidation and chemicals so that it retains its appearance without wear and without deterioration. In particular, a gold, silver, ruthenium, palladium or rhodium coating can be applied.

Figure 3:
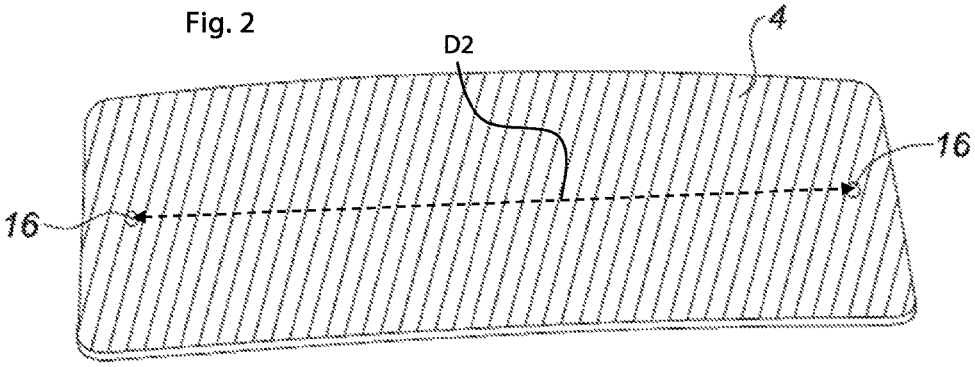

FIG. 3 shows a leather lining 4, forming an approximately rectangular strip with rounded corners, comprising a hole 16 near each end along the main axis of this strip. As a variant, the bracelet may have a different number of studs 10, for example one or three. It does not necessarily have any studs, the lining 4 may be retained by lateral tabs 12 and/or 15 alone, the lining being forced into contact with the inside of the curved structure 2 by its elastic effect that tends to straighten it.

Figure 4:
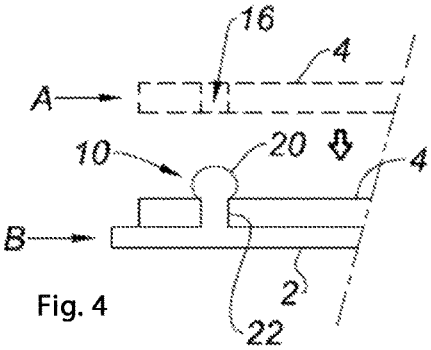
FIGS. 4 and 5 show cross-sectional views of how the lining is fixed on a stud head and a lateral fixing tab for this lining, respectively.

FIG. 4 shows the stud 10 with an approximately spherical head 20 fixed to the metal plate of the structure 2 by a short rod 22 welded vertically onto this metal plate. For a thin lining 4, the spherical head 20 alone can be fixed directly to the metal plate of the structure 2, without a rod. The diameter of the hole 16 in the lining 4 is slightly smaller than the diameter of the head 20.

The lining 4 is assembled by placing the hole 16 above the head 20 as shown in position A, and this lining is then lowered by pressing it onto the structure 2 so as to strain the material around the hole and enlarge it, to come into position B bearing on the metal plate. The spherical shape of the head 20 facilitates its insertion into the hole 16, and forms a curved surface that is not aggressive to the skin of the wrist.

Figure 5:
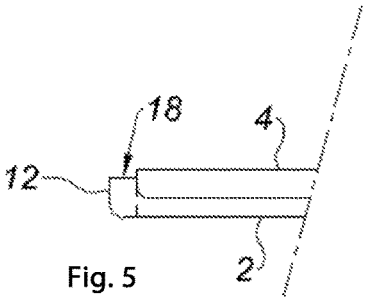

The height of the head 20 can be adjusted as a function of the lining 4 to obtain permanent vertical pressure on the lining by the head, leaving it firmly in contact with the metal plate of the structure 2. FIG. 5 shows the lateral tab 12 of the structure 2 that forms a 90° fold, the end 18 of which terminates slightly below the top level of the lining 4 so that it does not project above it and so that it will not irritate the skin of the wrist and will not get caught on anything.

Figure 6A:
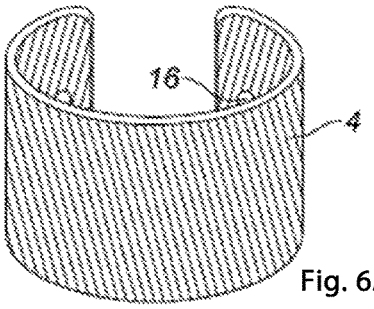
FIGS. 6A, 6B and 6C show the assembly of this bracelet.
Figure 6B:
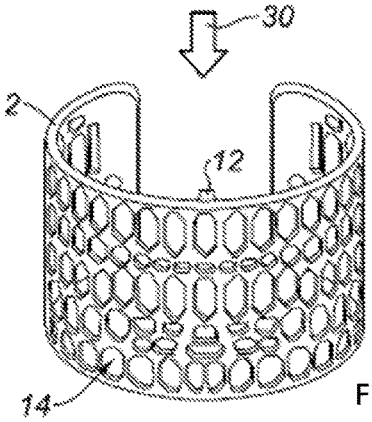
Figure 6C:
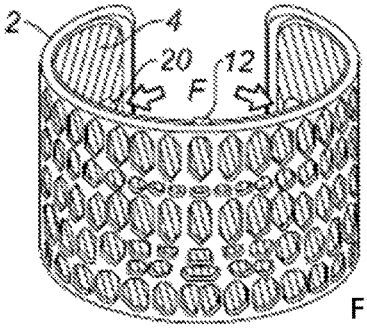

FIGS. 6A, 6B and 6C present the assembly method for the bracelet.

FIG. 6A shows firstly shaping of the lining 4 that is rolled to form a bend with a diameter slightly less than the diameter of the structure 2 below it, shown in FIG. 6B. The lining 4 is then lowered vertically by axial sliding along the direction of arrow 30, sliding it into the structure 2 to stop in contact with the lower lateral tab located under this structure. At this moment, the upper edge of the lining 4 also goes past the upper lateral tab 12. The lining 4 is then adjusted between the two lateral tabs 12 that form lateral packing in the two directions.

FIG. 6C then shows a pressure F applied to the inside of the lining 4 at each stud 10, to engage the studs 20 in the holes in this lining. In making the distance D2 between the two holes 16 in the lining 4 slightly larger than the clear distance D1 between the two heads 20 along the curvature of the structure, there will be a given lateral pressure between this lining and the metal plate retaining it in place with no play.

In general, the invention advantageously provides that the lateral distance D1 between two attachment means (the studs 10 or the lateral end tabs 15) along the contour of the back face of the structure 2 is less than the corresponding distance D2 on the lining 4, that is to say the distance D2, before fixing, between the points of the lining 4 where the attaching means will be engaged when the lining 4 is fixed and pressed against the back face of the structure: distance D2 between two holes 16 (FIG. 3), or distance D2 between two lateral end tabs 15 (FIG. 11).

This in order to apply lateral pressure to it and to force it into contact with the back face of the structure by these attachment means.

Furthermore, the slightly elastic shape memory of the lining 4 tends to maintain its separation inside the structure 2, which reinforces the pressure forcing it into contact inside this structure. The fast and simple mounting of the lining 4 without tools, assures efficient positioning that is maintained in the long term.

The result obtained is a bracelet that has the bright and luminous appearance of the metal structure 2 conferring the general shape of the jewelry due to its stiffness, decorated with openings 14 through which the leather lining 4 can be seen contributing colour and softness. In particular, a special relief can be chosen to given an appearance of luxury to the jewelry. The combination of two different technologies, metal decorated with cutouts with a metallic lustre and the leather of the lining requiring expertise in two different trades, provides a contrast offering unusual modern aesthetics.

The lining 4 is disassembled simply by pulling on its ends to disengage the heads 20 from the holes 16, and then by squeezing the curved part to disengage the lateral tabs 12 so that it can be extracted by sliding it laterally. It will be noted that no tools are required for disassembly, and that no part is modified or damaged.

Advantageously, there are two different colours on the two faces of the reversible lining 4, so that the same lining can be fitted in one direction or the other so as to obtain two different effects on the same jewelry.

As a variant, a lining 4 can be made with a surface formed by other materials such as natural or synthetic fabric, or a plastic material. If necessary, a stack of materials is made comprising a plate on the inside with some elasticity to control bending and provide a shape memory.

A lining 4 can also be made that projects beyond the sides of the structure at some locations, to be visible and give special aesthetics.

It would be possible to sell linings 4 separately from the rigid structures 2, for example metal structures, so that a large choice of appearances and colours could be available for a lower cost. The lining 4 could also be removed so that the metal structure 2 can be worn by itself, which gives an additional variant presentation. This could advantageously by done in the form of a decoration kit adapted to each rigid structure (a bracelet, pendant, ring, etc.), comprising a plurality of aesthetically different linings each provided with means (holes 16 or notches 16*a*) of cooperation with reversible attachment means (the studs 10 and/or the lateral tabs 12 and/or 15).

Figure 7:
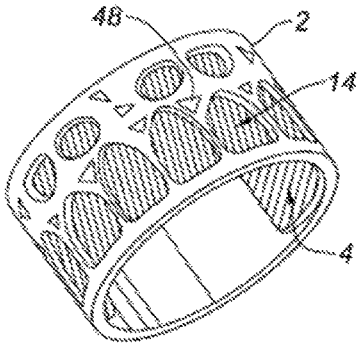
FIGS. 7 and 8 show two variants of rings according to the invention.

FIG. 7 shows a ring comprising a metal plate structure 2 wound to a small diameter to be adjusted to a finger, in which openings 14 are made to form a décor. Rows of small bushings 48 formed by stamping, chemical cutting or engraving of the metal plate finish the décor. In particular, etching can be used to economically create precise markings.

The lining 4 forming a strip is inserted into the structure 2 of the ring after having been wound by elastic deformation. Cavities in the inside surface of the structure 2, facing the lining 4 and formed by stamping, chemical cutting or engraving over the entire surface of this lining, form a retention cage applying pressure and locking to assure that it is retained in position.

Figure 8:
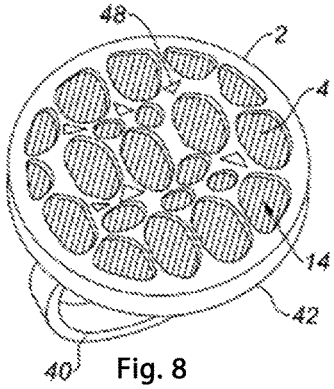

FIG. 8 show a decorative ring composed of a plain ring 40 designed to be adjusted around a finger, onto which a circular metallic structure 2 is welded comprising rows of openings 14 at its centre, with a circular rim around it forming a continuous bend facing the ring. The lining 4 is composed of a leather disk that is inserted by click fitting into a cage under the metal plate of the structure 2. The plain ring forming part of the decorative ring 40 holds the lining in its housing so that it is forced into contact under the metal plate of the structure 2.

Figure 9B:
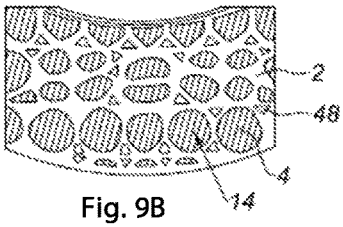
FIGS. 9A and 9B show an overview and a detailed view respectively of an open collar necklace according to the invention.
Figure 9A:
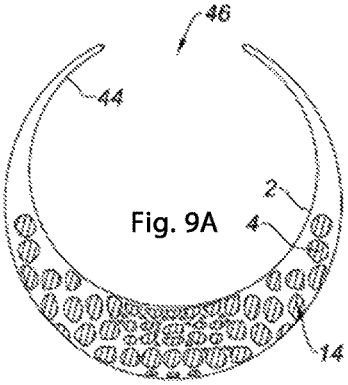

FIGS. 9A and 9B show an open collar necklace comprising a slightly convex metal structure 2 in a croissant shape, of which the tapered ends apply strong pressure to form a circular inner contour forming a passage 46 through which a person's neck will comfortably fit.

The structure 2 comprises rows of openings 14, and rows of small sized bushings 48 between these openings, made by stamping or etching of the metal plate, adding decorative elements. The result is thus a large metal structure 2 that is sufficiently stiff for this type of jewelry made of a single-piece cut metal sheet.

Figure 10A:
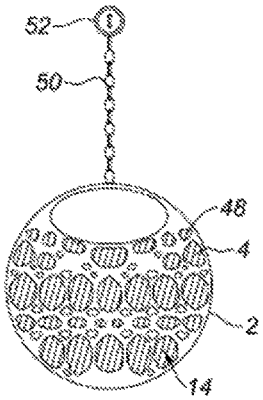
Figure 10B:
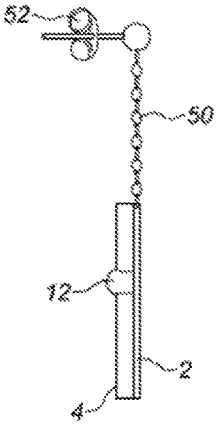

The lining 4 is forced into contact on the back face of the metal plate structure 2 by three studs that force the lining into contact with the metal plate of the structure 2 to retain it in place. FIGS. 10A and 1013 show an ear pendant composed of a flat metal plate structure 2 connected to an attachment pin 52 by a chain 50.

The structure 2 comprising rows of openings 14 is provided with tabs 12 at the back around its periphery forming points at which the lining 4 is laterally clamped by click fitting, to hold it in contact with the back face of this structure.

The invention claimed is:

1. A portable decorative element comprising:

a lining forming a plate that can be elastically bent; and, a rigid structure having decorative openings and a back face, the back face comprising a reversible attachment means fixed on the back face of the rigid structure, the reversible attachment means capable of holding the lining in place and pressing on the lining, forcing the lining into contact with the back face of the rigid structure;

wherein the lining can be seen through the decorative openings of the rigid structure.

2. The portable decorative element according to claim 1, in which the rigid structure is made from cutout metal plate with decorative openings.

3. The portable decorative element according to claim 1, wherein the back face further comprises lateral tabs forming attachment means applying pressure to the edges of the lining.

4. The portable decorative element according to claim 3, wherein the lateral tabs are formed by bending the edge of the metal plate of the structure.

5. The portable decorative element according to claim 1, wherein the reversible attachment means comprises two studs located on the back face of the rigid structure, the lining further comprising two holes, each hole configured to engage with a stud thereby forcing the lining onto the back face of the structure.

6. The portable decorative element according to claim 5, wherein each stud of the two studs comprises an approximately spherical head fixed on the back face of the structure at a distance such that there is compression through the thickness of the lining underneath this head.

7. The portable decorative element according to claim 1, wherein the lateral distance (D1) between two attachment means, along a contour of the back face of the structure, is less than the corresponding distance (D2) on the lining so as to apply lateral pressure to the lining and to force the lining into contact with the back face of the structure by the two attachment means.

8. The portable decorative element according to claim 1, wherein the rigid structure forms a bracelet comprising a metal plate strip approximately around a circle, with an opening through which the wrist can pass.

9. The portable decorative element according to claim 8, wherein the reversible attachment means comprises two studs located on the back face of the rigid structure, close to each end of the metal plate strip, and lateral tabs on the sides of this strip forming supports on the edges of the lining.

10. The portable decorative element according to claim 1, wherein the reversible attachment means comprises two end tabs located on the back face of the rigid structure, at each end of the rigid structure, and lateral tabs on the sides of this strip forming supports on the edges of the lining.

11. The portable decorative element according to claim 1, wherein the structure forms a disk comprising folded edges forming attachment means.

12. The portable decorative element according to claim 1, wherein the lining comprises two leather faces.

13. The portable decorative element according to claim 1, wherein the lining comprises two faces with different colours intended to be turned alternately towards the structure.

14. A portable decorative element comprising a rigid structure having decorative openings and a back face, the back face comprising a reversible attachment means fixed on the back face of the rigid structure, the reversible attachment means capable of holding a lining that can be elastically bent in place and pressing on the lining, forcing the lining into contact with the back face of the rigid structure, wherein the rigid structure is made from cutout metal plate with decorative openings and the back face further comprises lateral tabs forming attachment means applying pressure to the edges of the lining.

15. The portable decorative element according to claim 14, wherein the lateral tabs are formed by bending the edge of the metal plate of the structure.

16. The portable decorative element according to claim 14, wherein the reversible attachment means comprises two studs located on the back face of the rigid structure, the lining further comprising two holes, each hole configured to engage with a stud forcing the lining onto the back face of the structure.

17. The portable decorative element according to claim 16, wherein each of the two studs comprises an approximately spherical head, the two studs fixed on the back face of the structure at a distance such that there is compression through the thickness of the lining underneath this head.

18. The portable decorative element according to claim 14, wherein the lateral distance (D1) between two attachment means, along a contour of the back face of the structure, is less than the corresponding distance (D2) on the lining so as to apply lateral pressure to the lining and to force the lining into contact with the back face of the structure by the two attachment means.

19. The portable decorative element according to claim 14, wherein the rigid structure forms a bracelet comprising a metal plate strip approximately around a circle, with an opening through which the wrist can pass.

20. The portable decorative element according to claim 19, wherein the reversible attachment means comprises two studs located on the back face of the structure, close to each end of the metal plate strip, and lateral tabs on the sides of this strip forming supports on the edges of the lining.

21. The portable decorative element according to claim 14, wherein the reversible attachment means comprises two end tabs located on the back face of the rigid structure, at each end of the rigid structure, and lateral tabs on the sides of the rigid structure forming supports on the edges of the lining.

22. The portable decorative element according to claim 14, wherein the structure forms a disk comprising folded edges forming attachment means.

23. A portable decorative element comprising a lining forming a plate that can be elastically bent, the lining configured to reversibly attach with a rigid structure having decorative openings and a back face, the back face comprising a reversible attachment means fixed on the back face of the rigid structure, the reversible attachment means capable of holding the lining in place and pressing on the lining, forcing the lining into contact with the back face of the rigid structure.

24. The portable decorative element according to claim 23, wherein the lining comprises two leather faces.

25. The portable decorative element according to claim 23, wherein the lining comprises two faces with different colours intended to be turned alternately towards the structure.

26. A decoration kit for a decorative element, the decoration kit comprising a plurality of different decorative linings, each lining forming a plate that can be elastically bent, the lining configured to reversibly attach with a rigid structure having decorative openings and a back face, the back face comprising a reversible attachment means fixed on the back face of the rigid structure, the reversible attachment means capable of holding the lining in place and pressing on the lining, forcing the lining into contact with the back face of the rigid structure.

27. The decoration kit according to claim 26, wherein said each lining comprises two leather faces.

28. The decoration kit according to claim 26, wherein said each lining comprises two faces with different colours intended to be turned alternately towards the structure.

29. A portable decorative element comprising a rigid structure having decorative openings and a back face, the back face comprising a reversible attachment means fixed on the back face of the rigid structure, the reversible attachment means capable of holding a lining that can be elastically bent in place and pressing on the lining, forcing the lining into contact with the back face of the rigid structure wherein the lateral distance (D1) between two attachment means, along a contour of the back face of the structure, is less than the corresponding distance (D2) on the lining so as to apply lateral pressure to the lining and to force the lining into contact with the back face of the structure by the two attachment means.

30. The portable decorative element according to claim 29, in which the rigid structure is made from cutout metal plate with decorative openings.

31. The portable decorative element according to claim 30, wherein the back face further comprises lateral tabs forming attachment means applying pressure to the edges of the lining.

32. The portable decorative element according to claim 31, wherein the lateral tabs are formed by bending the edge of the metal plate of the structure.

33. The portable decorative element according to claim 29, wherein the reversible attachment means comprises two studs located on the back face of the rigid structure, the lining further comprising two holes, each hole configured to engage with a stud forcing the lining onto the back face of the structure.

34. The portable decorative element according to claim 33, wherein each of the two studs comprises an approximately spherical head, the two studs fixed on the back face of the structure at a distance such that there is compression through the thickness of the lining underneath this head.

35. The portable decorative element according to claim 29, wherein the rigid structure forms a bracelet comprising a metal plate strip approximately around a circle, with an opening through which the wrist can pass.

36. The portable decorative element according to claim 35, wherein the reversible means comprises two studs located on the back face of the structure, close to each end of the metal plate strip, and lateral tabs on the sides of this strip forming supports on the edges of the lining.

37. The portable decorative element according to claim 29, wherein the reversible attachment means comprises two end tabs located on the back face of the rigid structure, at each end of the rigid structure, and lateral tabs on the sides of the rigid structure forming supports on the edges of the lining.

38. The portable decorative element according to claim 29, wherein the structure forms a disk comprising folded edges forming attachment means.

39. A portable decorative element comprising a rigid structure having decorative openings and a back face, the back face comprising a reversible attachment means fixed on the back face of the rigid structure, the reversible attachment means capable of holding a lining that can be elastically bent in place and pressing on the lining, forcing the lining into contact with the back face of the rigid structure, wherein the structure forms a disk comprising folded edges forming attachment means.

40. The portable decorative element according to claim 39, in which the rigid structure is made from cutout metal plate with decorative openings.

41. The portable decorative element according to claim 40, wherein the back face further comprises lateral tabs forming attachment means applying pressure to the edges of the lining.

42. The portable decorative element according to claim 41, wherein the lateral tabs are formed by bending the edge of the metal plate of the structure.

43. The portable decorative element according to claim 39, wherein the reversible attachment means comprises two studs located on the back face of the rigid structure, the lining further comprising two holes, each hole configured to engage with a stud forcing the lining onto the back face of the structure.

44. The portable decorative element according to claim 43, wherein each of the two studs comprises an approximately spherical head, the two studs fixed on the back face of the structure at a distance such that there is compression through the thickness of the lining underneath this head.

45. The portable decorative element according to claim 39, wherein the lateral distance (D1) between two attachment means, along a contour of the back face of the structure, is less than the corresponding distance (D2) on the lining so as to apply lateral pressure to the lining and to force the lining into contact with the back face of the structure by the two attachment means.

46. The portable decorative element according to claim 39, wherein the rigid structure forms a bracelet comprising a metal plate strip approximately around a circle, with an opening through which the wrist can pass.

47. The portable decorative element according to claim 46, wherein the reversible means comprises two studs located on the back face of the structure, close to each end of the metal plate strip, and lateral tabs on the sides of this strip forming supports on the edges of the lining.

48. The portable decorative element according to claim 39, wherein the reversible attachment means comprises two end tabs located on the back face of the rigid structure, at each end of the rigid structure, and lateral tabs on the sides of the rigid structure forming supports on the edges of the lining.

* * * * *